United States Patent [19]

Hecker et al.

[11] 3,938,463

[45] Feb. 17, 1976

[54] INCLINED RAKED PARTIALLY SUBMERGED PROPELLERS

[75] Inventors: Richard Hecker, Germantown, Md.; Edward A. Butler, Arlington, Va.

[73] Assignee: The United States of America as represented by the Secretary of the Navy, Washington, D.C.

[22] Filed: May 4, 1973

[21] Appl. No.: 357,299

[52] U.S. Cl. ..... 115/34 R; 416/202

[51] Int. Cl.[2] ..... B63H 1/28

[58] Field of Search ..... 115/34, 40, 14; 416/202, 416/243; 114/66.5 H

[56] References Cited

UNITED STATES PATENTS

| | | | |
|---|---|---|---|
| 1,044,176 | 11/1912 | Hickman | 114/66.5 H |
| 2,684,654 | 7/1954 | Johnson | 115/34 R |
| 3,109,495 | 11/1963 | Lang | 114/66.5 H |
| 3,312,286 | 4/1967 | Irgens | 416/243 UX |
| 3,598,080 | 8/1971 | Shields | 115/14 |

*Primary Examiner*—Trygve M. Blix
*Assistant Examiner*—Galen L. Barefoot
*Attorney, Agent, or Firm*—R. S. Sciascia; Q. E. Hodges

[57] ABSTRACT

A highly efficient system for propelling high speed water borne craft is disclosed. The use of an inclined shaft which permits an efficient machinery arrangement is facilitated by driving the vessel by a unique propeller which is designed to operate while partially submerged. The propeller is raked to maximize the horizontal thrust component produced as the propeller blades sweep through the water. The partially submerged propeller provides an attractive method for reducing appendage drag which is associated with traditional horizontal or inclined propeller shaft systems. Further, this concept and design represents a propeller system which unique among propeller systems produces near zero transverse forces.

2 Claims, 3 Drawing Figures

INCLINED RAKED PARTIALLY SUBMERGED PROPELLERS

The invention described herein may be manufactured and used by or for the Government of the United States of America for governmental purposes without the payment of any royalties thereon or therefor.

BACKGROUND OF THE INVENTION

The invention relates to a device for propelling high speed water borne craft. This device permits an efficient machinery arrangement within the craft and precludes the loss of efficiency associated with traditional fully submerged inclined shaft propellers.

Horizontal shaft arrangements have been used to increase the efficiency of the propellers thrust by allowing the propeller blades to be positioned at a right angle to the flow stream. When horizontal shafts were used, machinery arrangements were cumbersome, extra gears had to be used and loss of efficiency due to transverse forces in the gearing system occurred.

When inclined shafts are used, traditional fully submerged propellers were placed at a non-orthogonal and therefore inefficient angle to the flow stream. If a fully submerged raked propeller were used, only a small increase in efficiency would be provided by arranging the rake so that the blade of the propeller were perpendicular to the stream during the downward stroke of each blade, since during the upward stroke of each blade, much of the effectiveness of the propeller would be lost. Only a small portion of that loss of effectiveness is tempered by the fact that the upper portion of the stream would be disturbed by the passing of the strut or vessel itself.

OBJECTS OF THE INVENTION

Accordingly, it is an object of the present invention to provide a high speed ship propulsion system which has a high efficiency.

Another object of the invention is to provide a better machinery arrangement within the water borne vessel.

A further object of the invention is to provide seventeen or more per cent increase in the efficiency of a ship propeller system.

Another object of the invention is to provide a ship propeller system which produces forward thrust with near zero transverse forces.

DESCRIPTION OF THE INVENTION

Figure 1:
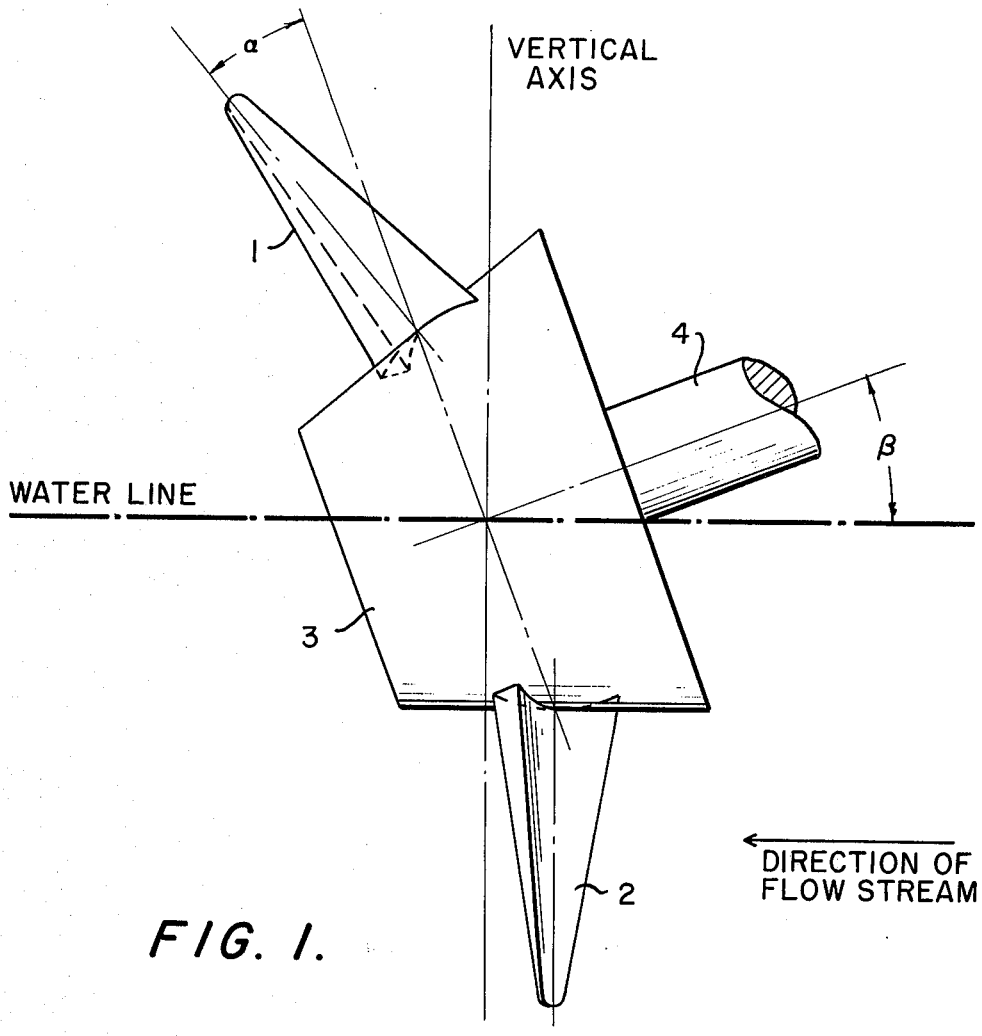
FIG. 1 is a side view of the inclined raked partially submerged propeller of this invention showing only two of the multiplicity of blades necessary in this invention.

Although new types of engines in various forms of propelling machinery have been developed over the past several years the screw propeller remains the most common device for propelling marine vehicles. The drag associated with a body moving through a fluid increases geometrically with the speed of the body. Therefore, as the design speeds of marine vehicles increase, the drag associated with appendages to such a body required to support the propeller such as shafts, struts, etc., become a large portion of the total drag. The partially submerged propeller offers an attractive method for reducing the appendage drag while maintaining and even enhancing efficiency. With the use of this invention, appendage drag is virtually eliminated since struts, shaft, etc. are out of the water. It must be recognized that in many instances a propeller's submergence will vary as the vehicle's speed changes; therefore, a partially submerged propeller, as disclosed by this invention, should include the possibility of variable pitch during operation. The design submergence of the propeller may vary so that the propeller is submerged to its centerline or less. It is critical to the operation of this concept that the vessel and power system be designed to provide approximately 50% propeller submergence. A propeller designed in accordance with this invention may effectively operate in a range of 30 to 50% submergence.

By allowing only partial submergence of an inclined shaft propeller, the efficiency of the propeller is substantially increased and vertical forces are reduced when the propeller blade rake is equal to or greater than the shaft angle. These vertical forces are thrust components in traditional inclined shaft propeller systems which tend to raise the vessel stern out of the water. In a partially submerged propeller the center of thrust is well below the shaft axis. Though the partially submerged propeller generates large bending moments in the shaft, there is no tendency of the stern to rise as in traditional inclined shaft systems. Such vertical forces in traditional inclined shaft systems result in great energy losses.

A variety of variables exist in the consideration of the general concept disclosed by this invention. For example, the propeller pitch ratio, submergence, shaft angle and rake angle can be varied to produce a variety of performance results. The rake angle should be equal to or greater than the shaft angle. For example, when a blade is substantially perpendicular to the flow it should be in the "six o'clock" position. In the three and nine o'clock position, the blade should be at or near the rake angle to the flow and at the twelve o'clock position, the blade is out of the water and inclined substantially twice the rake angle. Startling increases in efficiency are realized with the use of the inclined rake partially submerged propeller since the drag associated with traditional propellers is extremely high at the high vessel speed for which the partially submerged propeller concept is designed.

This new concept of raked inclined partially submerged propeller has shown, for example, an improvement of 17% in efficiency based on actual experimental results. Actual measured reduction in vertical forces of as much as 50% were found. An important benefit of the use of this invention is a desirable machinery arrangment due to higher permissible shaft angles which raise the forward end of the shaft higher above the keel. Propellers which are designed pursuant to this invention require a multiple of blades to permit smooth operation of the craft. Until the advant of the propeller system of the instant invention, the transverse force produced by a propeller has been an inevitable and continuing source of efficiency loss. This transverse force acts in a horizontal plane and transversely to the shaft axis. In traditional propellers designed for full submergence the transverse force is produced by the change in effective pitch as any given blade travels around its circular path. When the propeller blade is on its downward stroke side of the circular path, it is producing high thrust due to the high pitch with respect to the flow stream thus producing a high transverse force. Upon its upward stroke, the effective pitch is decreased and the thrust is less with the result that the counter transverse force is small. The sum of the transverse forces is a large force which tends to pull a vessel off of its path. Therefore, this resultant transverse force must be continually compensated for by rudder action. The need for this compensation represents significant losses in efficiency.

On the instant propeller system, the inclination of the shaft, approximately 50% submergence and super cavitating blade structure combine to produce transverse forces which sum to near zero. When a propeller blade of the instant invention is on its downward sweep, it, like its traditional counterpart, produces a high transverse force. However, uniquely to this invention's design concept is the production of a higher counter transverse force upon upsweep. This force is produced since high thrust on the upsweep is produced by supercavitation flow retardation. The sum of these opposing transverse forces is approximately zero. Therefore, for the first time, a ship can be built which will remain on a true course when its rudder is aligned with the centerline of the ship. The result in terms of decreases in overall power consumption is significant. As is well known, when a supercavitating propeller operates it creates a pressure field in the fluid about it and especially ahead of itself. In the case where the propeller is partially submerged, the pressure field is highly unequal and asymmetric. The high transverse forces which occur on the normal partially submerged propeller are caused in part by partial submergence but mostly by the asymmetric pressure fluid.

The instant invention reduces the transverse forces by attuning the instantaneous pitch of the propeller blade to the unequal pressure field. The procedure for doing so is to incline the shaft and rake the propeller blades, thus producing a varience of instantaneous pitch which will increase the flow retardation during upsweep by increasing the intermediate angle of the blade so that it produces a larger cavity, hence retarding the flow which counteracts the transverse force produced during downsweep.

In the design of a propeller, in accordance with this invention, with a selected shaft angle ($\psi$), pitch ratio (P/D) and percent submergence (S), a unique rake angle ($\alpha$) can be selected to produce substantially zero transverse forces during its operation.

FIG. 1 is a side view of the propeller of the instant invention showing only two of the multiplicity of blades necessary. The propeller blades 1 and 2 are raked at an angle $\alpha$. As shown by the drawing, the shaft is at an angle of $\beta$ with the horizontal. When a blade is in the six o'clock position, such as blade 2, it will be at a right angle to the flow stream. At the three and nine o'clock positions, the blades will be at the water line and at the rake angle to the flow stream. When blades are out of the water then they would, if fully submerged, as in a traditional propeller system, be at angles of attack greater than the rake angle. The maximum angle of twice the rake angle is reached when a blade is in the twelve o'clock position. If fully submerged, such a propeller configuration will produce a non-horizontal thrust component which would tend to raise the stern of the vessel. This problem is avoided by the instant invention since the thrust component is in the direction of motion of the vessel not along the shaft.

Figure 2:
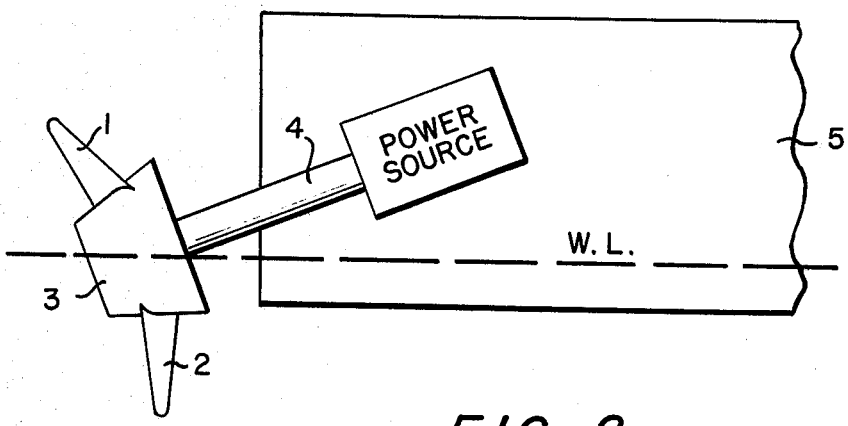
FIG. 2 is a side view of the partially submerged propulsion system.

FIG. 2 is a side view of the ship propulsion system as it would appear in operation. Propeller hub 3 supports each of a multiplicity of blades 1 and 2 (only two of the multiplicity of blades are shown for purposes of clarity). The shaft is inclined to allow for an efficient machinery arrangement without the otherwise necessary and inefficient gearing system or standard inclined shaft propeller system. The buoyancy of the vessel 5 during operation is designed for 30 to 50% submergence of the propeller in accordance with the concept of the invention.

Figure 3:
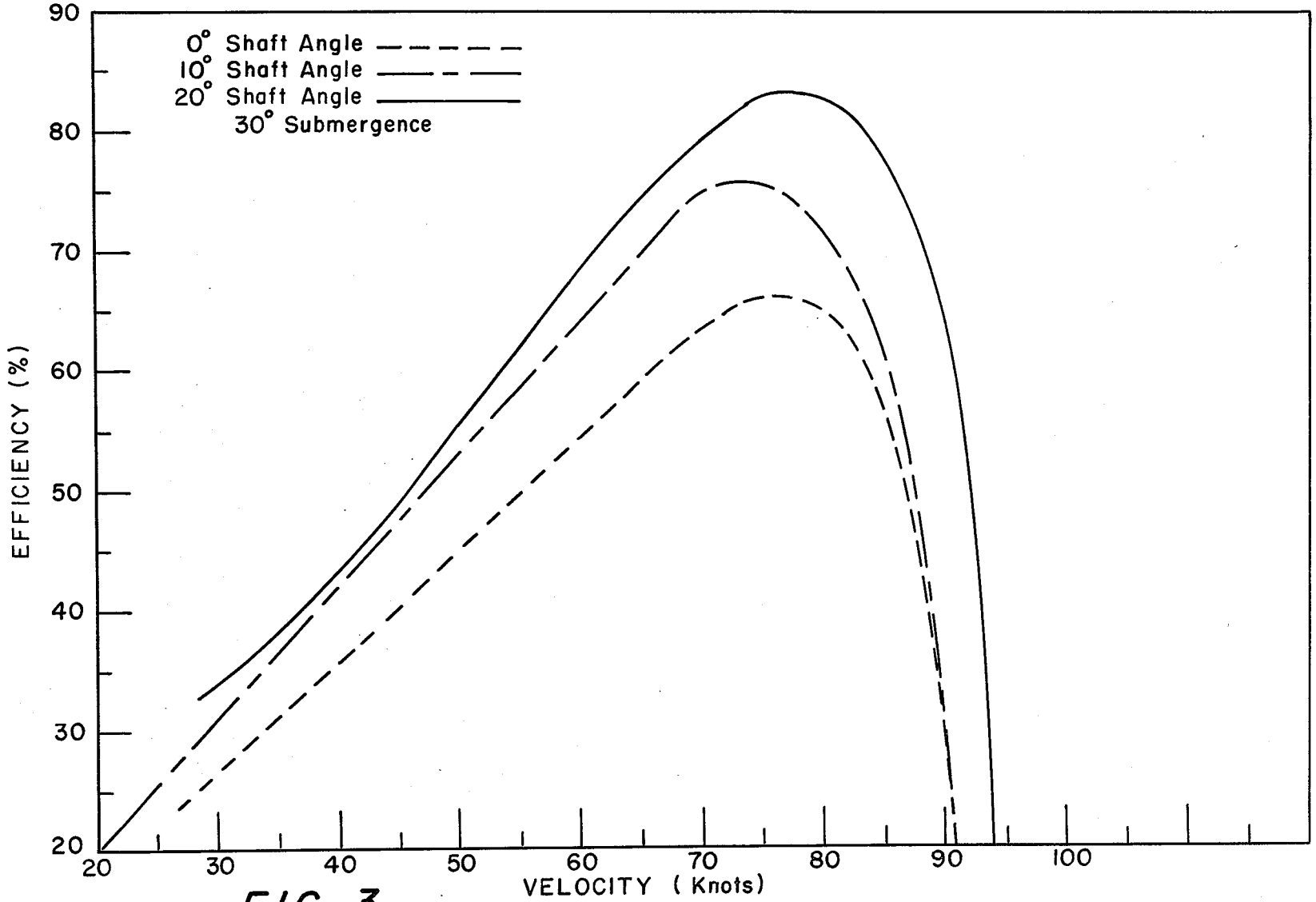
FIG. 3 is a comparative graph based on actual experimental results, of the efficiency of the power system of the instant invention at various shaft angles.

FIG. 3 is a graph of a raked partially submerged propeller of the instant invention showing the increased efficiency as the shaft angle approaches the rake angle.

The instant invention virtually eliminates inefficiency due to both vertical thrust components as well as transverse forces.

Obviously many modifications and variations of the present invention are possible in the light of the above teachings. It is therefore to be understood that within the scope of the appended claims the invention may be practiced otherwise than as specifically described.

What is claimed is:

1. A method for propelling a surface ship with an inclined shaft raked multi-blade supercavitating screw propeller, comprising:

rotating a screw propeller in the range of 30 to 50% submergence in water;

producing a substantially horizontal thrust from blade interaction with water only during the lower 180° of the circle of rotation of each blade;

producing a positive transverse thrust component during the first half of the duration of a blade's engagement with water; and, producing a retarded flow and high negative transverse thrust component during the second half of the duration of a blade's engagement with water which is substantially equal to said positive transverse force.

2. A method of propelling a surface ship with an inclined shaft raked multiple bladed propeller, comprising:

rotating a raked screw type propeller through four quadrants of a circle of rotation about a shaft, the first two quadrants, I and II, being above the water line and quadrants III and IV below the water line;

producing a substantially horizontal thrust with each blade during the third and fourth quadrants of rotation;

producing a high positive transverse force during the third quadrant of blade rotation;

producing a high negative transverse force substantially equal to said high positive force during the fourth quadrant of rotation; and, producing substantially zero thrust during the first and second quadrant of rotation.

* * * * *